US008633648B2

(12) United States Patent
Tanibata et al.

(10) Patent No.: US 8,633,648 B2
(45) Date of Patent: Jan. 21, 2014

(54) GAS CONVERSION SYSTEM

(75) Inventors: Toru Tanibata, Cupertino, CA (US); Jae-Mo Koo, Palo Alto, CA (US); Sang Hun Lee, San Ramon, CA (US)

(73) Assignee: ReCarbon, Inc., Sunnyvale, CA (US)

( * ) Notice: Subject to any disclaimer, the term of this patent is extended or adjusted under 35 U.S.C. 154(b) by 64 days.

(21) Appl. No.: 13/526,653

(22) Filed: Jun. 19, 2012

(65) Prior Publication Data

US 2013/0002137 A1 Jan. 3, 2013

Related U.S. Application Data

(60) Provisional application No. 61/501,767, filed on Jun. 28, 2011.

(51) Int. Cl.
*H01J 7/24* (2006.01)

(52) U.S. Cl.
USPC ..... 315/111.21; 315/111.01; 315/111.51; 315/111.81; 315/111.91

(58) Field of Classification Search
USPC ..... 315/111.01–111.91
See application file for complete search history.

(56) References Cited

U.S. PATENT DOCUMENTS

| | | | | |
|---|---|---|---|---|
| 4,423,303 | A | 12/1983 | Hirose et al. | |
| 4,698,822 | A | 10/1987 | Leprince et al. | |
| 5,131,992 | A * | 7/1992 | Church et al. | 204/164 |
| 5,234,502 | A | 8/1993 | Mochizuki et al. | |
| 5,242,663 | A | 9/1993 | Shiomi et al. | |
| 5,262,610 | A * | 11/1993 | Huang et al. | 219/121.43 |
| 5,479,254 | A * | 12/1995 | Woskov et al. | 356/316 |
| 5,489,362 | A | 2/1996 | Steinhardt et al. | |
| 5,929,570 | A | 7/1999 | Shinohara et al. | |
| 6,224,836 | B1 | 5/2001 | Moisan et al. | |
| 6,340,863 | B1 | 1/2002 | Ikeda et al. | |
| 6,401,653 | B1 | 6/2002 | Taniguchi et al. | |
| 6,429,399 | B1 | 8/2002 | Yanagisawa et al. | |
| 6,558,635 | B2 * | 5/2003 | Minaee et al. | 422/186 |
| 6,593,507 | B2 | 7/2003 | Ikeda et al. | |
| 6,600,084 | B2 | 7/2003 | Ikeda et al. | |
| 6,635,997 | B2 | 10/2003 | Ikeda et al. | |
| 6,650,059 | B2 | 11/2003 | Ikeda et al. | |
| 7,554,053 | B2 | 6/2009 | Kamarehi et al. | |
| 2002/0127155 | A1 | 9/2002 | Minaee | |
| 2005/0199586 | A1 | 9/2005 | Matsushita et al. | |
| 2007/0007257 | A1 * | 1/2007 | Uhm et al. | 422/186 |
| 2010/0254863 | A1 * | 10/2010 | Lee et al. | 422/186 |
| 2012/0235569 | A1 * | 9/2012 | Lee et al. | 315/111.41 |

FOREIGN PATENT DOCUMENTS

| | | | |
|---|---|---|---|
| JP | 2003-027241 | A | 1/2003 |
| JP | 2003-164723 | A | 6/2003 |

* cited by examiner

*Primary Examiner* — Daniel Cavallari
*Assistant Examiner* — Srinivas Sathiraju
(74) *Attorney, Agent, or Firm* — Patent Office of Dr. Chung Park

(57) ABSTRACT

A gas conversion system using microwave plasma is provided. The system includes: a microwave waveguide; a gas flow tube passing through a microwave waveguide and configured to transmit microwaves therethrough; a temperature controlling means for controlling a temperature of the microwave waveguide; a temperature sensor disposed near the gas flow tube and configured to measure a temperature of gas flow tube or microwave waveguide; an igniter located near the gas flow tube and configured to ignite a plasma inside the gas flow tube so that the plasma converts a gas flowing through the gas flow tube during operation; and a plasma detector located near the gas flow tube and configured to monitor the plasma.

17 Claims, 6 Drawing Sheets

GAS CONVERSION SYSTEM

CROSS REFERENCE TO RELATED APPLICATIONS

This application claims the benefit of U.S. Provisional Applications No. 61/501,767, entitled "Gas conversion system," filed on Jun. 28, 2011, which is incorporated by reference in its entirety.

BACKGROUND OF THE INVENTION

1. Field of the Invention

The present invention relates to gas conversion systems, and more particularly to systems converting gases using multiple gas conversion means with microwave plasma.

2. Discussion of the Related Art

In recent years, microwave technology has been applied to generate various types of plasma. In some applications, required capacity of gas conversion using plasma is very large, and it requires a high power microwave generator. The existing microwave techniques are not suitable, or at best, highly inefficient due to one or more of the following drawbacks. First, the existing systems lack proper scalability, where scalability refers to the ability of a system to handle varying amounts of gas conversion capacity in a graceful manner or its ability to be enlarged/reduced to accommodate the variation of the gas conversion capacity. For instance, the required gas conversion capacity may widely vary depending on the applications. Second, the economics of scale for a magnetron increases rapidly as the output power increases. For instance, the price of a 10 kW magnetron is much higher than the price of ten 1 kW magnetrons. Third, the system configured with a higher power magnetron would have a possibility that the whole system needs to be shutdown once either magnetron or plasma applicator has an issue. Thus, there is a need for a gas conversion system that has high scalability, less system down time, and is cheaper than currently available gas conversion system without compromising the gas conversion capacity.

SUMMARY OF THE INVENTION

In one embodiment of the present disclosure, a gas conversion system using a microwave plasma includes: a microwave waveguide for transmitting microwaves therethrough; a gas flow tube passing through the microwave waveguide and configured to transmit the microwaves through the gas flow tube; a first temperature controlling means for controlling a temperature of the microwave waveguide; a temperature sensor disposed near the gas flow tube and configured to measure a temperature of the microwave waveguide; an igniter located near the gas flow tube and configured to ignite a plasma inside the gas flow tube so that the plasma converts a gas flowing through the gas flow tube during operation; and a plasma detector located near the gas flow tube and configured to monitor the plasma.

In one embodiment of the present disclosure, a gas conversion system includes: an inlet gas manifold for supplying a gas; and a plurality of gas conversion units connected to the inlet gas manifold and configured to receive the gas therefrom. Each of the plurality of gas conversion units includes: a microwave waveguide for transmitting microwaves therethrough; a gas flow tube passing through the microwave waveguide and configured to transmit the microwaves through the gas flow tube; a first temperature controlling means for controlling a temperature of the microwave waveguide; a temperature sensor disposed near the gas flow tube and configured to measure a temperature of the microwave waveguide; an igniter located near the gas flow tube and configured to ignite a plasma inside the gas flow tube so that the plasma converts a gas flowing through the gas flow tube during operation; and a plasma detector located near the gas flow tube and configured to monitor the plasma. The gas conversion system also includes an outlet gas manifold connected to the plurality of gas conversion units and configured to receive therefrom.

DETAILED DESCRIPTION OF THE PREFERRED EMBODIMENTS

Figure 1:
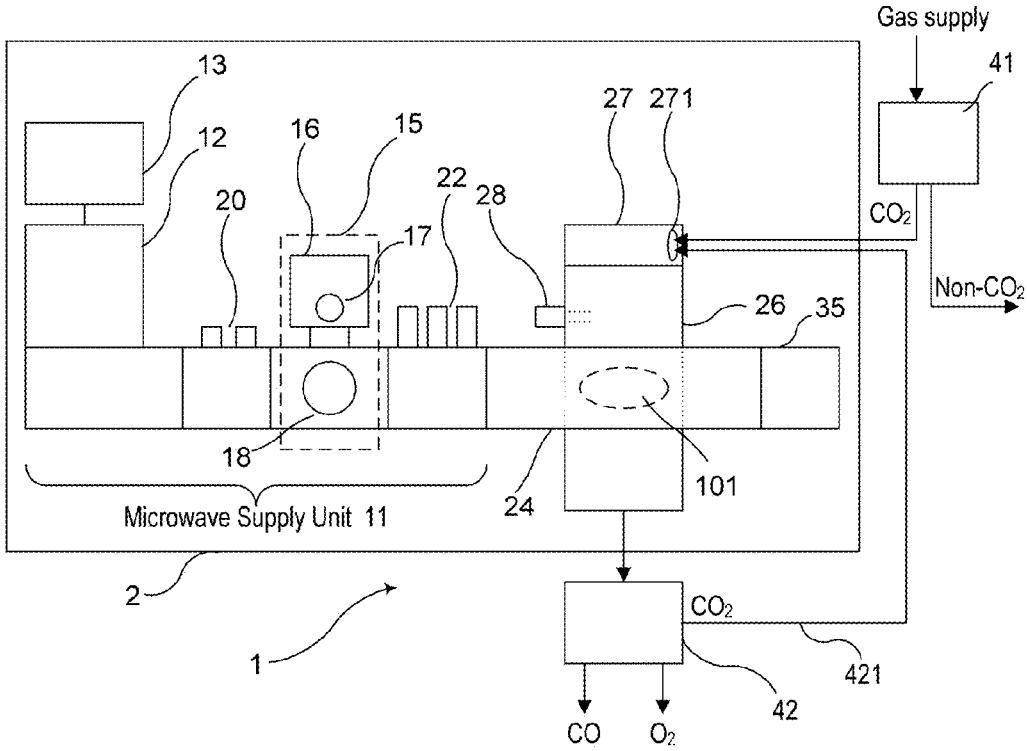
FIG. 1 is a schematic diagram of a gas conversion system in accordance with one embodiment of the present invention.

FIG. 1 is a schematic diagram of a gas conversion system 1 for generating microwave plasma and converting gas in accordance with one embodiment of the present invention. As illustrated, the gas conversion system 1 may include: a gas flow tube 26 that is transparent to microwave, such as glass, ceramic, or any other dielectric materials, preferably formed of quartz; a microwave supply unit 11 for providing microwave to the gas flow tube 26; and a waveguide 24 for transmitting microwave from the microwave supply unit 11 to the gas flow tube 26, where the gas flow tube 26 receives a gas and/or gas mixture from a gas supply, such as flue gases.

The microwave supply unit 11 provides microwave to the gas flow tube 26 and may include: a microwave generator 12 for generating microwave; a power supply 13 for supplying power to the microwave generator 12; and an isolator 15 having a dummy load 16 for dissipating reflected microwave that propagates toward the microwave generator 12 and a circulator 18 for directing the reflected microwave to the dummy load 16.

In one embodiment, the microwave supply unit 11 further includes a coupler 20 for measuring microwave powers; another coupler 17 located on the dummy load 16 to measure reflected microwave power to be dissipated at the dummy load 16; and a tuner 22 for reducing the microwave reflected from the gas flow tube 26. The components of the microwave supply unit 11 shown in FIG. 1 are well known and are listed herein for exemplary purposes only. Also, it is possible to replace the microwave supply unit 11 with a system having the capability to provide microwave to the gas flow tube 26 without deviating from the present invention. A phase shifter may be mounted between the isolator 15 and the tuner 22.

The gas conversion system 1 may include a high voltage spark igniter 28 on the gas flow tube 26 for an easy ignition of plasma in the gas flow tube 26; a top cap 27 having a gas inlet 271 to receive gas and supply it into the gas flow tube 26; and a sliding short 35 to adjust a standing wave position for an efficient plasma. The top cap 27 is preferably made of a metal to avoid microwave leakage through the top of the gas flow tube 26. Gas flow inside the gas flow tube 26 may have a swirling motion since the gas inlet 271 is configured as a side injection. The gas inlet 271 may be configured as a top injection to have a straight flow (not having a swirling motion) or may be configured as an angled injection.

The gas conversion system 1 may be used for a flue gas treatment. More particularly, it may be used for conversion of CO2 in the flue gas into CO and O2 by use of the plasma 101. The gas conversion system 1 may include an inlet gas separator 41 for separating the flue gas into CO2 and other components. The inlet gas separator 41 may use an existing method, such as absorption, cryogenic, or membrane. The inlet gas separator 41 supplies CO2 to the gas flow tube 26 through the gas inlet 271. A converted gas exhausted from the gas flow tube 26 is supplied to an outlet gas separator 42 for separating the converted gas into CO, O2, and CO2. The outlet gas separator 42 may use an existing method, such as absorption, pressure swing adsorption, or membrane. CO2 separated by the outlet gas separator 42 may be circulated to the gas inlet 271 for further conversion. Thus, the gas separator 42 and a gas line 421 form a gas circulation system.

Figure 2A:
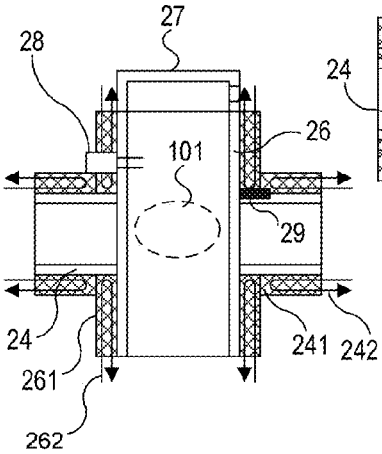
FIGS. 2A-2C are schematic cross sectional views of alternative embodiments of a portion of the gas conversion system in FIG. 1.

FIG. 2A is a schematic cross sectional view of an alternative embodiment of a portion of the gas conversion system 1 in FIG. 1. As depicted, temperature controlling means 241 and 261 are installed onto the waveguide 24 and the gas flow tube 26 respectively, to control the temperatures of the waveguide 24 and the gas flow tube 26, respectively. Each of the temperature controlling means 241 and 261 may be a water-cooling system, a cooling system using other coolants, or a heater using a heating medium such as hot water, oil, or gas. The flows of the medium for the temperature controlling means 241 and 261 are shown as arrows 242 and 262. The temperatures of the waveguide 24 and the gas flow tube 26 may be controlled by adjusting the medium flow rate and by sensing the temperature of waveguide or gas flow tube using a thermometer 29.

Figure 2B:
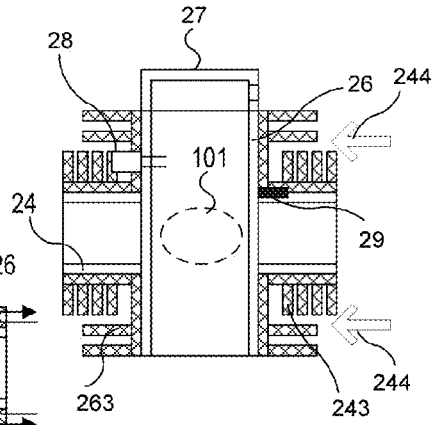

FIG. 2B is a schematic cross sectional view of an alternative embodiment of a portion of the gas conversion system 1 in FIG. 1. As depicted, air-cooling means, such as heat sink, 243 and 263 are installed onto the waveguide 24 and the gas flow tube 26 respectively, to control the temperatures of the waveguide 24 and the gas flow tube 26, respectively. The air flow for cooling is illustrated as arrows 244. The temperatures of the waveguide 24 and the gas flow tube 26 may be controlled by adjusting air flow rate and by sensing the temperature using a thermometer 29.

Figure 2C:
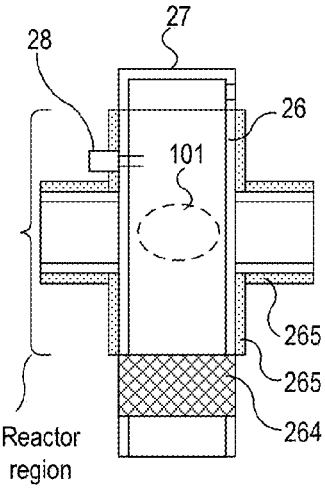

FIG. 2C is a schematic cross sectional view of an alternative embodiment of a portion of the gas conversion system 1 in FIG. 1. As depicted, a heat exchanger 264 is installed at downstream of the gas flow tube 26 so that the temperature of the gas exiting the reactor region is maintained at a predetermined level. The reactor region may be insulated with an insulation material 265 so that the gas temperature in the reactor region is maintained at a higher level to thereby increase the conversion efficiency of the reactor. The heat exchanger 264 may be a rapid gas cooling means using a coolant, such as water.

Figure 3A:
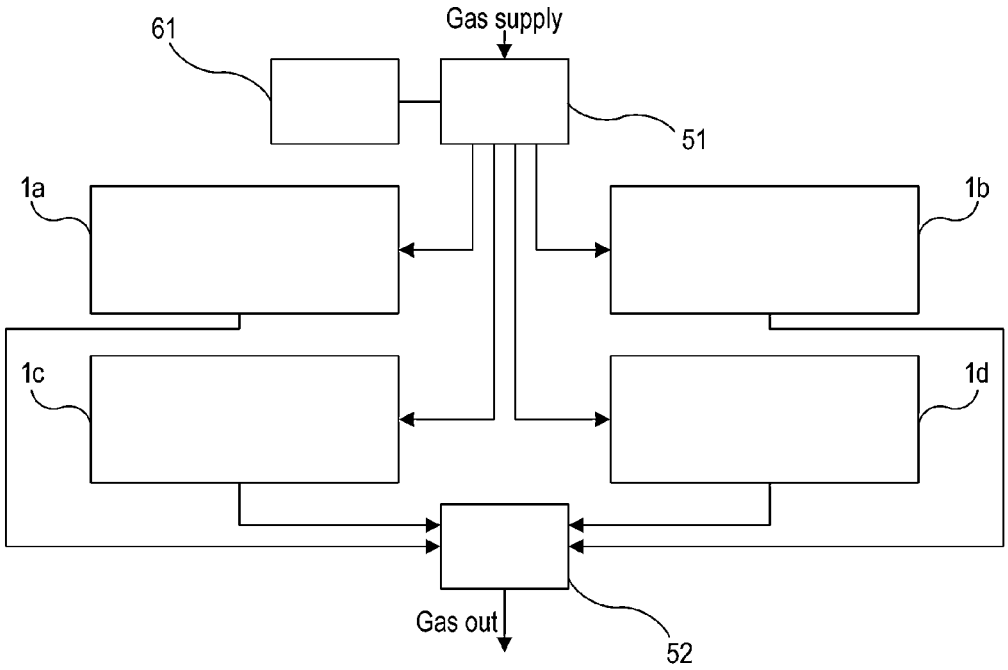
FIGS. 3A-3B are schematic diagrams of various embodiments of an integrated gas conversion system according to the present invention.
Figure 3B:
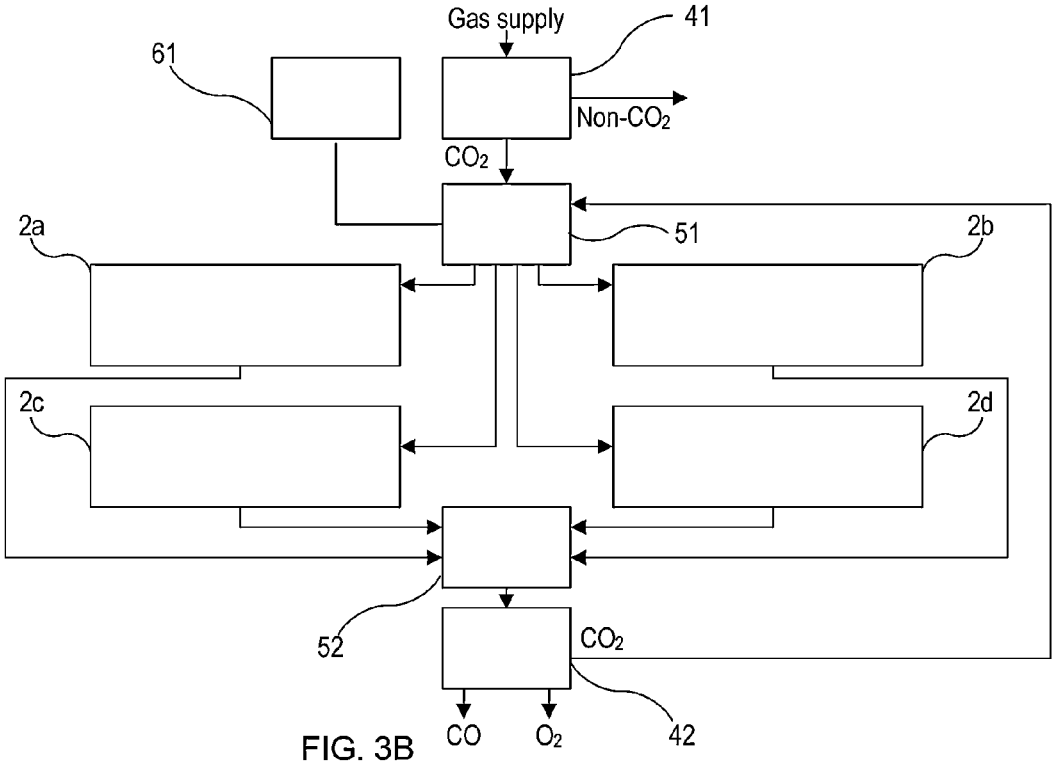

FIGS. 3A-3B are schematic diagrams of various embodiments of an integrated gas conversion system according to the present invention. FIG. 3A illustrates an integrated gas conversion system having the four gas conversion systems 1*a*-1*d*, where each of the four gas conversion systems 1*a*-1*b* is similar to the system 1 shown in FIG. 1. The flue gas is supplied to an inlet gas manifold 51 controlled by a controller 61. The flue gas supplied to each of the four gas conversion systems 1*a*-1*d* is separated by a gas separator and converted by use of plasma, and subsequently sent to an outlet gas manifold 52. Since each gas conversion system 1*a*-1*d* has similar mechanisms and functions of the system 1 in FIG. 1, gas separation and CO2 circulation are done inside of the gas conversion systems 1*a*-1*d*. When the gas conversion system fails to operate, i.e., the plasma is extinguished inadvertently, the controller 61 controls gas distributions from the inlet gas manifold 51 so that the gas is not supplied to the failed gas conversion system. In addition, the controller 61 may control the total gas flow rate supplied to the gas conversion systems depending on the number of the gas conversion systems under operation. A detector for monitoring the plasma in each reactor region is described in conjunction with FIG. 5.

FIG. 3B illustrates another integrated gas conversion system having the four gas conversion units 2*a*-2*d*. Each gas conversion system 2*a*-2*d* has similar mechanisms and functions of the gas conversion unit 2 in FIG. 1. The gas conversion unit 2, as depicted in FIG. 1, does not contain any inlet/outlet gas separator or gas circulation system. The flue gas is supplied to the inlet gas separator 41 and separated CO2 is supplied to the inlet gas manifold 51 controlled by the controller 61. CO2 supplied to the four gas conversion systems 2*a*-2*d* are converted by plasma, and subsequently sent to the outlet gas manifold 52. The converted gas collected at the outlet gas manifold 52 is supplied to the outlet gas separator 42. Since each gas conversion system 2*a*-2*d* does not contain any gas separator or gas circulation system in FIG. 1, the gas separation and CO2 circulation are done outside of the gas conversion units 2*a*-2*d*. When the gas conversion system fails to operate, i.e., the plasma is extinguished inadvertently, the controller 61 controls gas distributions from the inlet gas manifold 51 so that the gas is not supplied to the failed gas conversion system. In addition, the controller 61 may control the total gas flow rate supplied to the gas conversion systems depending on the number of the gas conversion systems under operation. A detector for monitoring the plasma in each reactor region is described in conjunction with FIG. 5.

Based on the embodiment shown in FIG. 3B, one may configure another integrated gas conversion system by moving the outlet gas separator 42 and the CO2 circulation system into each gas conversion systems 2*a*-2*d*. Or one may configure another integrated gas conversion system by moving only the outlet gas separator 42 into each gas conversion systems 2*a*-2*d*.

Figure 4:
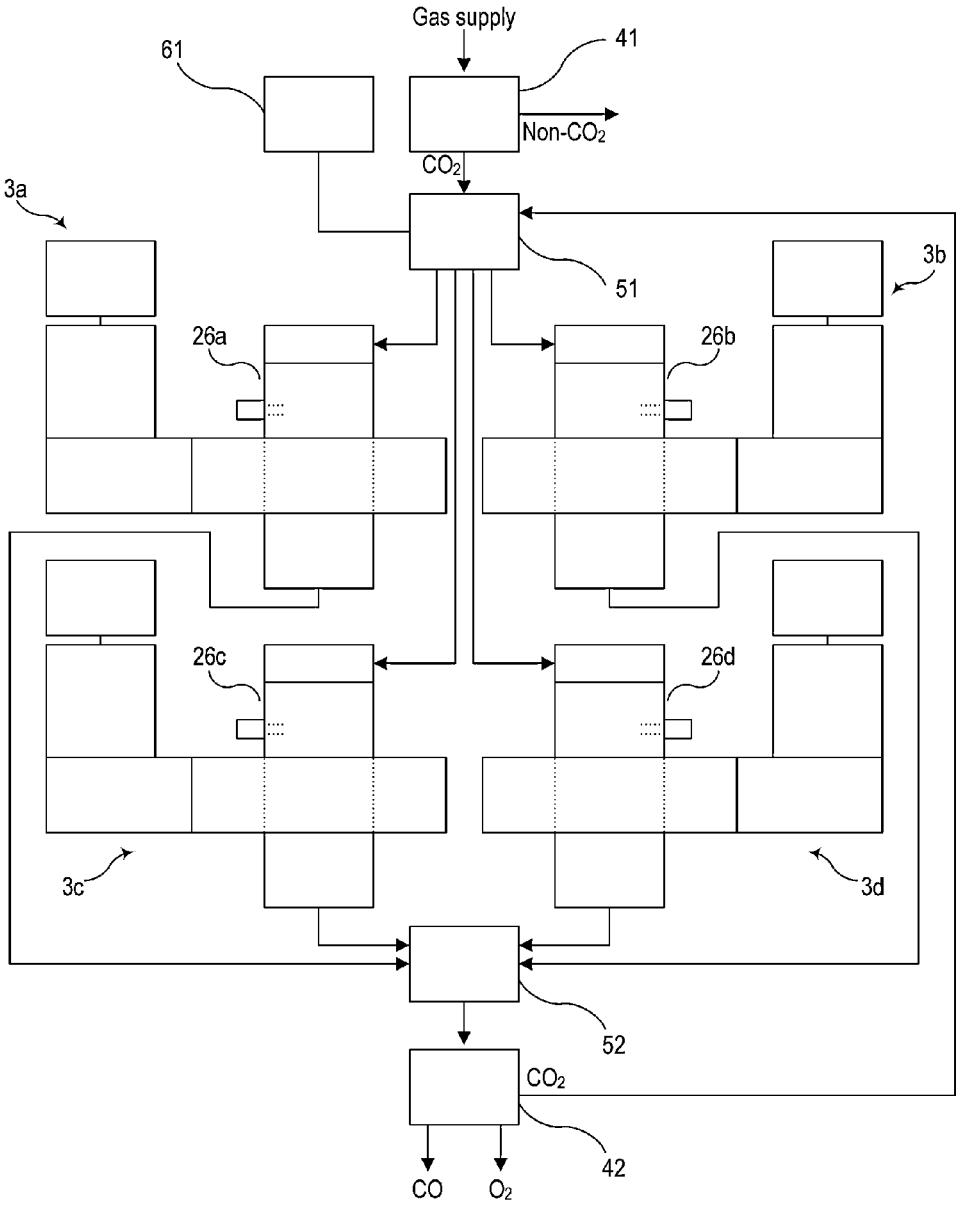
FIG. 4 is a schematic diagram of an integrated gas conversion system in accordance with another embodiment of the present invention.

FIG. 4 illustrates another integrated gas conversion system containing the four gas conversion systems 3*a*-3*d*. Each of the gas conversion systems 3*a*-3*d* is similar to the gas conversion unit 2 in FIG. 1, with the difference that each of the gas conversion systems 3*a*-3*d* does not include the isolator 15, the coupler 20, the tuner 22, and the sliding short 35. Each of the gas conversion systems 3*a*-3*d* is fully optimized for efficient plasma generation, and thus these elements are not required for proper operation of the system. The flue gas is supplied to the inlet gas separator 41 and separated CO2 is supplied to the inlet gas manifold 51 controlled by a controller 61. The separated CO2 is supplied to the four gas conversion systems 3*a*-3*d* having four gas flow tubes 26*a*-26*d*, respectively, and subsequently converted by the plasma, and then sent to the outlet gas manifold 52. The converted gas collected at the outlet gas manifold 52 is supplied to the outlet gas separator 42. Since each gas conversion system does not have any gas separation or CO2 circulation system, gas separation and CO2 circulation are done outside the gas conversion systems 3*a*-3*d*. When the gas conversion system fails to operate, i.e., the plasma is extinguished inadvertently, the controller 61 controls gas distributions from the inlet gas manifold 51 so that the gas is not supplied to the failed gas conversion system. In addition, the controller 61 may control the total gas flow rate supplied to the gas conversion systems depending on the number of the gas conversion systems under operation. A detector for monitoring the plasma in each reactor region is described in conjunction with FIG. 5.

Figure 5:
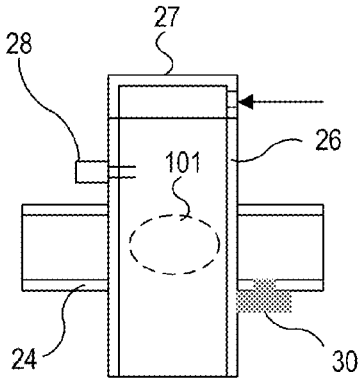
FIG. 5 is a schematic cross sectional view of an alternative embodiment of a portion of the gas conversion system in FIG. 1 according to the present invention.

FIG. 5 is a schematic cross sectional view of an alternative embodiment of a portion of the gas conversion system in FIG. 1 according to the present invention. As depicted, a plasma detector 30 is installed onto the waveguide 24 to monitor the plasma, to thereby monitor the proper operation of the gas conversion system 1. The plasma detector 30 may be an optical sensor to detect a light emission of plasma or a temperature sensor to detect a temperature increase due to plasma generation. The plasma detector 30 may be installed on the gas flow tube 26 instead.

Figure 6:
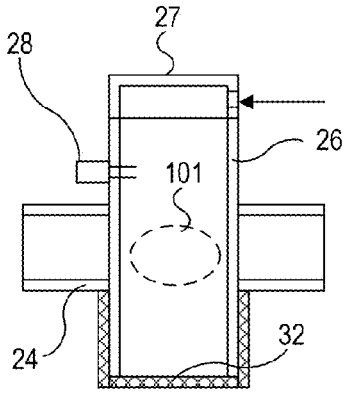
FIG. 6 is a schematic cross sectional view of an alternative embodiment of a portion of the gas conversion system in FIG. 1 according to the present invention.
Figure 7A:
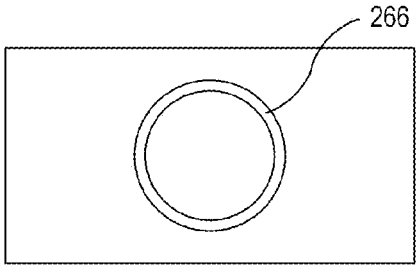
FIGS. 7A-7D are top views of alternative embodiments of the gas flow tube in FIG. 1 according to the present invention.
Figure 7B:
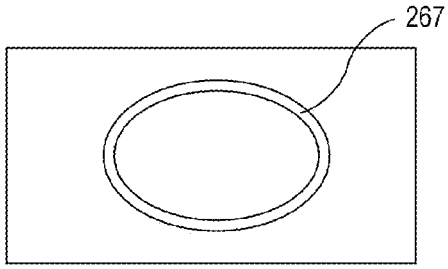
Figure 7C:
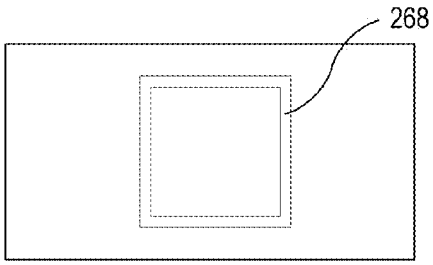
Figure 7D:
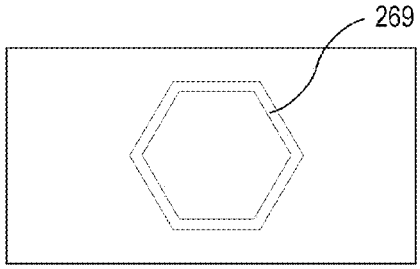

FIG. 6 is a schematic cross sectional view of an alternative embodiment of a portion of the gas conversion system 1 in FIG. 1 according to the present invention. A mesh plate 32, preferably a grounded metal mesh plate, is installed at the bottom of the gas flow tube 26 to enhance the stability of gas flow and plasma, and to avoid a microwave leakage through the bottom of the gas flow tube 26. The mesh size of the mesh plate 26 is much smaller than the wavelength of the microwave generated by the microwave supply unit 11. It is preferred to install the mesh plate 32 at a location having a certain distance from the bottom surface of the waveguide 24 to have enough volume for plasma and avoid arcing inside the gas flow tube 26.

FIGS. 7A-7D are top views of alternative embodiments of the gas flow tube 26 in FIG. 1 according to the present invention. As depicted, the cross sectional shape of the gas flow tubes 266-269 may be circle, oval, square, rectangle, or hexagon. It should be apparent to those of ordinary skill that other suitable geometrical shape can be used.

Figure 8A:
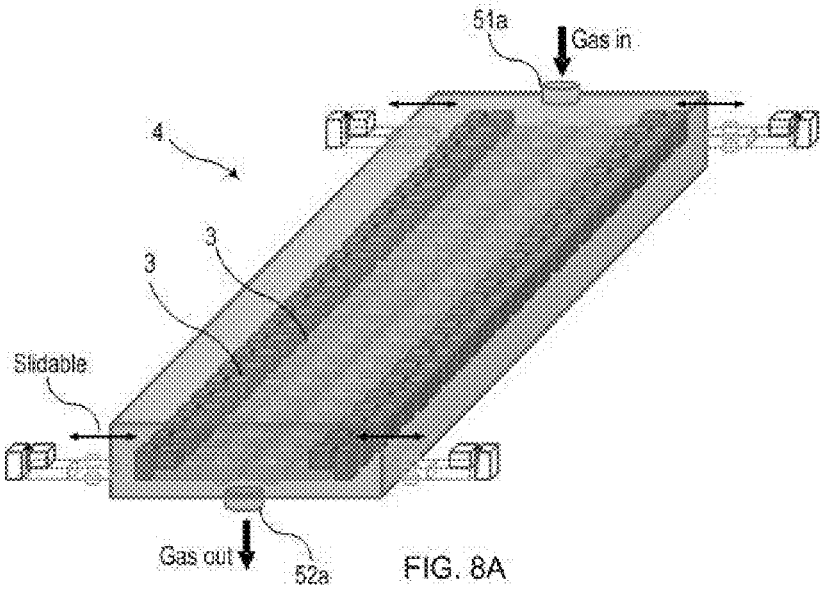
FIGS. 8A-8B are perspective views of alternative embodiments of the integrated gas conversion system in FIG. 4 according to the present invention.

FIG. 8A is a perspective view of an alternative embodiment of the integrated gas conversion system in FIG. 4 according to the present invention. As depicted, the integrated gas conversion module 4 includes a plurality of, say fifty, gas conversion systems 3. It contains an inlet gas manifold 51*a* controlled by a controller (not shown) and an outlet gas manifold 52*a*. Each gas conversion system 3 is slidably mounted so that it can be easily accessed when maintenance is required.

Figure 8B:
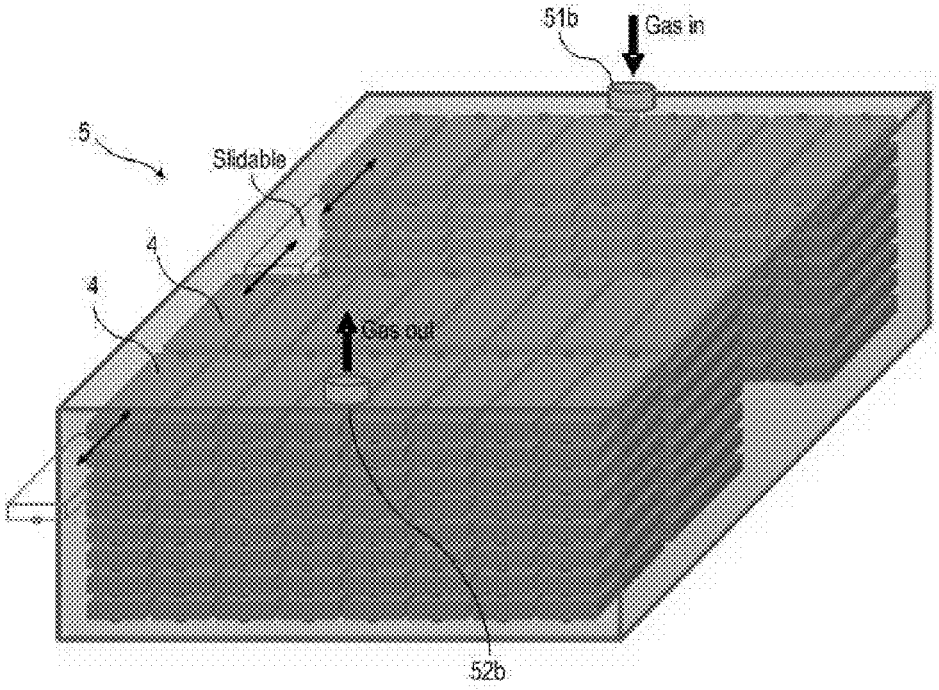

FIG. 8B is a perspective view of an alternative embodiment of the integrated gas conversion system in FIG. 4 according to the present invention. As depicted, an integrated gas conversion system 5 includes a plurality of, say one hundred and ninety two, gas conversion modules 4. It contains an inlet gas manifold 51*b* controlled by a controller (not shown) and an outlet gas manifold 52*b*. Each gas conversion module 4 is slidably mounted so that it can be easily accessed when maintenance is required. The flue gas is supplied to the inlet gas separator (not shown) and separated CO2 is supplied to the inlet gas manifold 51*b* and then supplied to each gas conversion system 3 through the inlet gas manifold 51*a* on the gas conversion modules 4. The gas converted by plasma is collected to the outlet gas manifold 52*b* through the outlet gas manifold 52*a* on the gas conversion modules 4, and then delivered to the outlet gas separator (not shown). The operations before the inlet gas separator and after the outlet gas separator including CO2 circulation are the same as the system shown in FIG. 4, and the descriptions are not repeated for brevity.

Figure 9A:
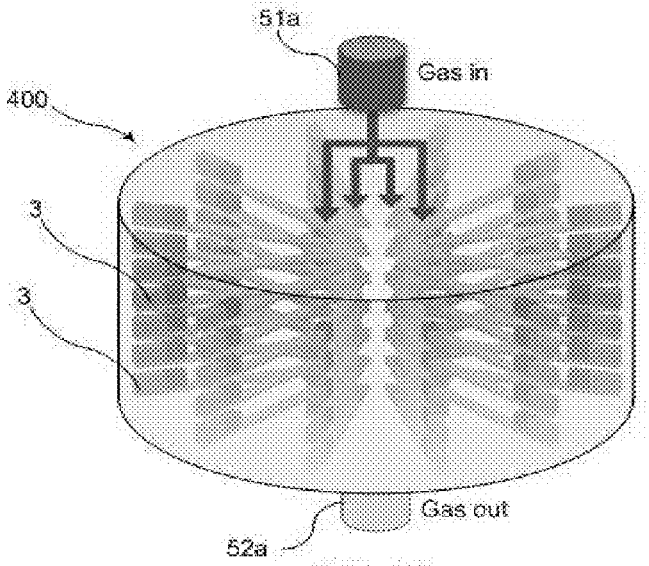
FIGS. 9A-9B are perspective views of alternative embodiments of the integrated gas conversion system in FIG. 4 according to the present invention.

FIG. 9A is a perspective view of an alternative embodiment of the integrated gas conversion system in FIG. 4 according to the present invention. As depicted, the integrated gas conversion module 400 includes a plurality of, say sixty, gas conversion systems 3. It contains an inlet gas manifold 51*a* controlled by a controller (not shown) and an outlet gas manifold 52*a*. Each gas conversion system 3 is radially arranged so that gas tubing is concentrated at the center for ease of plumbing and the human operator has enough space for maintenance.

Figure 9B:
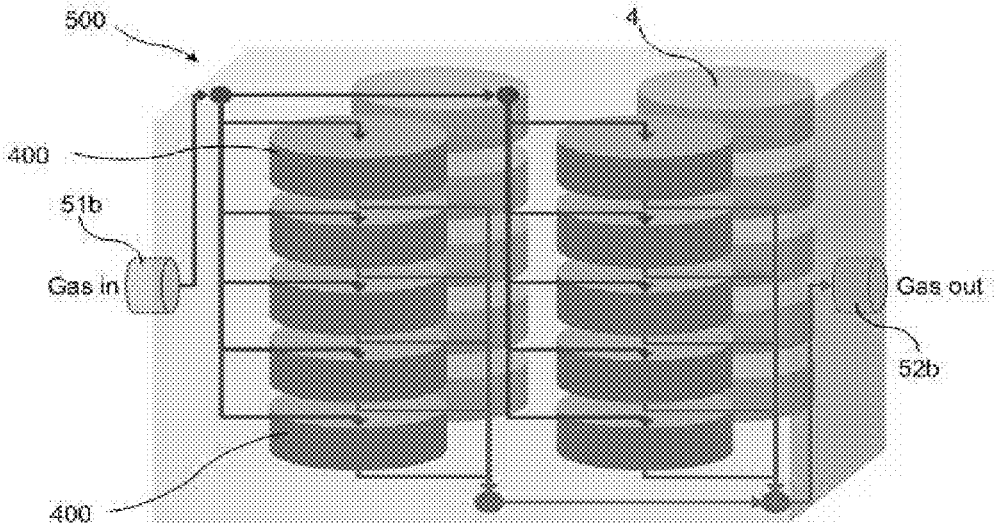

FIG. 9B is a perspective view of an alternative embodiment of the integrated gas conversion system in FIG. 4 according to the present invention. As depicted, an integrated gas conversion system 500 includes a plurality of, say twenty, gas conversion modules 400. It contains an inlet gas manifold 51*b* controlled by a controller (not shown) and an outlet gas manifold 52*b*. The flue gas is supplied to the inlet gas separator (not shown) and separated CO2 is supplied to the inlet gas manifold 51*b* and then supplied to each gas conversion system 3 through the inlet gas manifold 51*a* on the gas conversion modules 400. The gas converted by plasma is collected to the outlet gas manifold 52*b* through the outlet gas manifold 52*a* on the gas conversion modules 400, and then delivered to the outlet gas separator (not shown). The operations before the inlet gas separator and after the outlet gas separator including CO2 circulation are the same as the system shown in FIG. 4, and the descriptions are not repeated for brevity.

It is noted that the integrated gas conversion systems shown in FIGS. 3A, 3B, and 4 have only four gas conversion systems. It is also noted that the integrated gas conversion module shown in FIG. 8A and the integrated gas conversion system shown in FIG. 8B have fifty gas conversion systems and the one hundred and ninety two gas conversion modules, respectively. However, it should be apparent to those of ordinary skill in the art that the module or system may include any other suitable number of gas conversion modules or systems. Likewise, integrated gas conversion modules shown in FIGS. 9A and 9B may have other suitable number of gas conversion systems and modules.

The price of the microwave generator 12*a*, especially the magnetron, increases rapidly as its power output increases. For instance, the price of ten magnetrons of the commercially available microwave oven is considerably lower than that of one high power magnetron that has an output power ten times that of the microwave oven. Thus, the multiple gas conversion systems in FIGS. 3A-8B allow the designer to build a low cost gas conversion system without compromising the total conversion capacity. Also, it allows for establishing a system having less system down time when a failure occurs by controlling the gas distribution.

It should be understood, of course, that the foregoing relates to exemplary embodiments of the invention and that modifications may be made without departing from the spirit and scope of the invention as set forth in the following claims.

What is claimed is:

1. A gas conversion system using a microwave plasma, comprising:

a microwave waveguide for transmitting microwaves therethrough;

a gas flow tube passing through the microwave waveguide and configured to transmit the microwaves through the gas flow tube;

a first temperature controlling means for controlling a temperature of the microwave waveguide;

a temperature sensor disposed near the gas flow tube and configured to measure a temperature of the microwave waveguide;

an igniter located near the gas flow tube and configured to ignite a plasma inside the gas flow tube so that the plasma converts a gas flowing through the gas flow tube during operation; and a plasma detector located near the gas flow tube and configured to monitor the plasma.

2. A gas conversion system as recited in claim 1, further comprising:

a gas inlet disposed on the gas flow tube and configured to receive the gas.

3. A gas conversion system as recited in claim 1, further comprising:

a second temperature controlling means for controlling a temperature of the gas flow tube.

4. A gas conversion system as recited in claim 3, wherein the second temperature controlling means includes a cooling system using a coolant.

5. A gas conversion system as recited in claim 1, where the gas contains carbon dioxide and the plasma is adapted to convert the carbon dioxide into carbon monoxide and oxygen.

6. A gas conversion system as recited in claim 1, further comprising:

a grounded metal mesh plate disposed at a bottom of the gas flow tube and configured to prevent microwave leakage through the gas flow tube.

7. A gas conversion system as recited in claim 1, further comprising:

an inlet gas separator located upstream of the gas flow tube and configured to separate carbon dioxide contained in the gas from other components of the gas;

an outlet gas separator located downstream of the gas flow tube and configured to separate carbon dioxide contained in the gas converted by the plasma; and a gas line for directing the carbon dioxide separated by the outlet gas separator to a gas inlet of the gas flow tube to thereby form a gas circulation system.

8. A gas conversion system as recited in claim 1, wherein the gas flow tube is configured to impart a swirling motion to the gas.

9. A gas conversion system as recited in claim 1, wherein the gas flow tube is made of quartz.

10. A gas conversion system as recited in claim 1, wherein the first temperature controlling means includes a cooling system using a coolant.

11. A gas conversion system as recited in claim 1, wherein the plasma detector is an optical sensor for sensing a light emission from the plasma.

12. A gas conversion system as recited in claim 1, wherein the igniter is a high voltage spark igniter.

13. A gas conversion system as recited in claim 1, further comprising:

a temperature sensor disposed near the gas flow tube and configured to measure a temperature of the gas flow tube.

14. A gas conversion system, comprising:

an inlet gas manifold for supplying a gas;

a plurality of gas conversion units coupled to the inlet gas manifold and configured to receive the gas therefrom, each of the plurality of gas conversion units including:

a microwave waveguide for transmitting microwaves therethrough;

a gas flow tube passing through the microwave waveguide and configured to transmit microwaves therethrough;

a first temperature controlling means for controlling a temperature of the microwave waveguide;

a temperature sensor disposed near the gas flow tube and configured to measure a temperature of the microwave waveguide;

an igniter located near the gas flow tube and configured to ignite a plasma inside the gas flow tube so that the plasma converts the gas flowing through the gas flow tube during operation; and a plasma detector located near the gas flow tube and configured to monitor the plasma; and an outlet gas manifold connected to the plurality of gas conversion units and configured to receive therefrom.

15. A gas conversion system as recited in claim 14, wherein each of the plurality of gas conversion unit further includes:

an inlet gas separator;

an outlet gas separator; and a gas line for directing carbon dioxide separated by the outlet gas separator to a gas inlet of the gas flow tube to thereby form a gas circulation system.

16. A gas conversion system as defined in claim 14, further comprising:

an inlet gas separator disposed upstream of the inlet gas manifold;

an outlet gas separator disposed downstream of the outlet gas manifold; and a gas line for directing carbon dioxide separated by the outlet gas separator to the inlet gas manifold to thereby form a gas circulation system.

17. A gas conversion system as recited in claim 14, wherein each of the plurality of gas conversion unit further includes a second temperature controlling means for controlling a temperature of the gas flow tube.

* * * * *